United States Patent [19]

Evans, Jr. et al.

[11] 4,196,340

[45] Apr. 1, 1980

[54] ELECTROLYTIC STEAM IRON HAVING MEANS TO MINIMIZE MOISTURE CONDENSATION ON THE SOLEPLATE

[75] Inventors: Ross M. Evans, Jr., Upland, Calif.; Donald J. Siebold, Naperville, Ill.

[73] Assignee: General Electric Company, New York, N.Y.

[21] Appl. No.: 884,765

[22] Filed: Mar. 9, 1978

[51] Int. Cl.[2] ..... H05B 3/60; D06F 75/110

[52] U.S. Cl. ..... 219/245; 38/69; 38/77.8; 38/77.9; 38/85; 38/93; 219/254; 219/275; 219/284

[58] Field of Search ..... 219/271–276, 219/284–295, 245, 254; 68/222; 38/69, 82, 89, 74, 84, 88, 77.1–77.9, 93, 85; 239/136

[56] References Cited

U.S. PATENT DOCUMENTS

| | | | |
|---|---|---|---|
| Re. 28,418 | 5/1975 | Osrow | 38/69 |
| 1,544,502 | 6/1925 | Thomas et al. | 219/245 |
| 1,804,827 | 5/1931 | Everts | 38/84 |
| 2,437,571 | 3/1948 | Waage | 38/89 X |
| 2,499,835 | 3/1950 | Rakos | 38/77.7 |
| 2,515,776 | 7/1950 | Kassab | 38/77.83 |
| 2,547,558 | 4/1951 | Bremer | 38/77.7 |
| 2,575,465 | 8/1956 | Myers | 38/77.6 |
| 2,676,239 | 4/1954 | Sanzone et al. | 219/271 |
| 2,861,365 | 11/1958 | Block | 38/77.82 |
| 3,263,350 | 8/1966 | Abraham | 38/77.7 |
| 3,319,046 | 5/1967 | Katzman et al. | 219/275 |
| 3,610,879 | 10/1971 | Katzman | 219/271 |
| 3,646,317 | 2/1972 | Osrow | 219/271 |
| 3,755,649 | 8/1973 | Osrow | 219/245 |
| 3,969,607 | 7/1976 | Osrow et al. | 219/272 |

*Primary Examiner*—A. Bartis

*Attorney, Agent, or Firm*—John F. Cullen; George R. Powers; Leonard J. Platt

[57] ABSTRACT

A lightweight plastic electrolytic steam iron has a soleplate with steam distributing means therefrom and a casing of electrically non-conducting material forming the walls of an internal water tank coextensive with and extending over the soleplate. Spaced electrodes are supported in the rear of the tank to generate steam from the water therein and an insulated steam conduit extends from the soleplate upwardly into the tank to direct saturated steam from the tank through the steam distributing means to the surface being ironed. To this general combination, an improvement for minimizing condensation of moisture on the soleplate adds a thin chamber disposed between the tank and the soleplate and parallel and coextensive with them to separate the tank and soleplate over substantially their entire facing surfaces. The thin chamber in one version may be sealed to the soleplate casing to form a dead air space between the tank and soleplate and, in another version, may contain a thin layer or blanket of steam between the tank and the soleplate.

5 Claims, 3 Drawing Figures

ELECTROLYTIC STEAM IRON HAVING MEANS TO MINIMIZE MOISTURE CONDENSATION ON THE SOLEPLATE

BACKGROUND OF THE INVENTION

1. Field of the Invention

This invention relates to a lightweight steam iron made of plastic and of the electrolytic version wherein steam is generated by applying current to internal electrodes to provide saturated steam to the ironing surface. A specifically formed thin insulating chamber containing dead air or generated steam is formed between the water tank and soleplate to provide even heat distribution to the soleplate and permit steam generation in either the horizontal or vertical position.

2. Description of the Prior Art

Irons using plastic for as many parts as possible have come into general use. Typically, such irons may be electrolytic wherein a molded plastic casing contains an internal water tank with spaced electrodes generating steam and a soleplate integral with the water tank is provided as shown in U.S. Pat. Nos. 3,755,649 and 3,969,607. Such irons use plastic soleplates of appropriate material and some can be operable horizontally as an iron or vertically as a steamer as shown in Re28,418. Such irons or steamers use the plastic soleplate as one side of the tank wall to abut the internal water tank directly against the soleplate whereby its temperature is limited to the temperature of the water. This also permits the use of many different types of plastic soleplates and is generally the type of Re28,418. While such arrangements adequately perform the job for which they are designed, they do not permit the use of metallic soleplates because of sealing difficulties. Metallic soleplates permit operation at higher temperatures needed in many ironing operations so the plastics are limited to lightweight touchup and/or use with low temperature synthetics.

SUMMARY OF THE INVENTION

It is an object of this invention to provide a lightweight electrolytic steam iron using plastic construction where the soleplate may be either plastic or metal that is operable at a higher temperature than the common electrolytic iron permits.

Another object is to provide a thin chamber between the plastic tank and soleplate, whether plastic or metal, to insulate the two providing for even heat distribution to the soleplate.

A further object is to seal the thin chamber to form a dead air space between the tank and soleplate or, in an alternate construction, permit entrance of steam to the thin chamber to provide for higher operating soleplate temperatures and avoid condensation problems normally encountered.

Briefly described, there is provided a lightweight steam iron having a soleplate with steam distributing means in its outer surface and a casing of electrically non-conducting material forming an internal water tank that is coextensive with and over the soleplate. Spaced electrodes are supported within the tank preferably in the rear thereof to generate steam from the water, and an insulated steam conduit extends from the soleplate upwardly into the tank for directing saturated steam from the tank through the steam distributing means to the surface being ironed. To this general structure, there is provided an improvement that comprises a thin chamber disposed between the tank and soleplate that is parallel and coextensive with them so the chamber separates the tank and soleplate over substantially their entire facing surfaces. The chamber may be either completely insulated to form a dead air space or may have means to introduce steam therein. Such arrangement of thin air space forms an insulating layer between a coverplate forming the tank bottom and the top of the soleplate. This permits the use of either a metallic or plastic soleplate and providing for even heat distribution to the soleplate. Thus, the main object of the invention is to provide a lightweight plastic steam iron that generates steam electrolytically, uses few parts, and introduces a thin or flat insulating chamber between the internal water tank and soleplate for even heat distribution to the soleplate and permitting use of plastic or metallic soleplates.

DESCRIPTION OF THE PREFERRED EMBODIMENT

Figure 1:
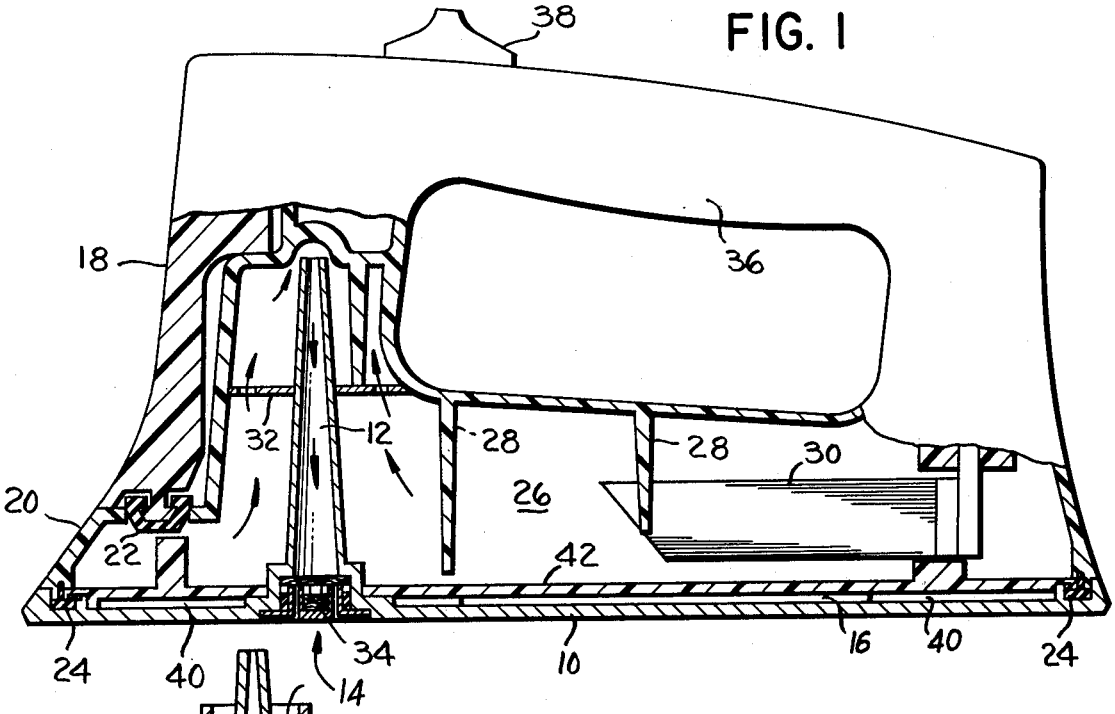
FIG. 1 is an elevation cross-section of line 1—1 of FIG. 2 partially broken showing the invention applied to a plastic iron.

The invention is described in connection with a lightweight steam iron that uses a conventional aluminum soleplate modified for the invention although it will be appreciated that it is applicable to any iron using adjoining plastic parts of the general type shown in U.S. Pat. No. 4,115,935 of common assignment directed to sealing structure for such plastic irons. While the structure to be described is most applicable to lightweight plastic irons of the electrolytic version and will be described in connection therewith, the structure may be applied to any flooded boiler iron as will be apparent. Referring first to FIG. 1, there is shown an electric steam iron that includes a soleplate 10 that may employ a plurality of ports to direct steam to the soleplate for steaming fabrics while ironing in the conventional manner or, as shown, uses a single insulated steam conduit 12 that is preferably plastic to direct generated steam out a single port generally indicated at 14 that connects with steam distributing channels 16 fanning out from the port in the bottom of the soleplate to spread the steam over a larger area of the soleplate. Channels 16 may be cast or molded into the underside of the soleplate as is well known.

The iron is provided with a molded plastic casing 18 forming an exterior wall positioned above an intermediate plastic member 20 and sealed thereto by a watertight clamping seal 22, the intermediate member in turn being connected to soleplate 10 and sealed thereto by suitable sealing means 24 with the soleplate being either metallic or plastic as preferred. The sealing structure per se forms no part of the instant invention and particular seals for connecting the plastic parts are described and claimed in the U.S. Pat. No. 4,115,935. Intermediate plastic member 20 is disposed directly above the soleplate and is substantially coextensive with the soleplate to form a skirt around it and it is spaced from the soleplate as shown and supported thereon by the sealing means 24. For providing steam, an internal water tank 26 is partially formed by the wall of casing 18 and plastic member 20 which is sealed to the casing. The general arrangement is not significant except that the internal tank 26 is formed directly out of the plastic and extends over the entire soleplate to be coextensive therewith as shown in FIG. 1. Suitable baffles 28 are molded in the tank for dampening surges in the water. The heating structure for generating steam from the water in the tank comprises spaced electrodes 30 that are supported within the tank. Heat is created by the passage of current between the electrodes which, preferably, are supported in the rear of the iron so they are at least partially immersed in the water at all times whether the iron is flat or in a vertical position. This insures steam generation for either ironing or for use of the device as a steamer. The electrodes are partially submerged in a water solution that contains dissolved salts to improve the ionization and form a good electrolyte. This arrangement is well known and is generally shown in patent Re28,418 that is used both as an iron and a steamer.

For preventing the carryover of water drops from the boiling water in tank 26, a suitable apertured partition 32 is provided in the upper part of the tank and surrounding elongated insulated steam conduit 12 open at the top and extending upwardly from the soleplate into the tank. Thus, steam formed by boiling water in the tank is saturated steam which rises and, under pressure, is forced down conduit 12, through a filter 34 in the conduit and upstream or before the distributing channels 16 through the channels and thence into the fabric being ironed. The iron has an open or closed handle 36 with a control button 38 that connects the circuit, through a cord not shown to activate the electrodes 30 and generate heat and steam.

In the prior art such as Re28,418, it has been common to form the soleplate and water tank as a single piece molding whereby the soleplate is directly cooled by the internal water on the other side thereof. Since the soleplate temperature is thus limited by the cooling effect of the water, there can be a tendency to form condensation on the soleplate which is not desirable. Additionally, the maximum temperature is limited by the temperature of the water on the inner surface of the soleplate. Additionally, metallic soleplates cannot be used with such construction because they would be electrically live. It has been determined, as in the present invention, numerous advantages are obtained by the use of a thin chamber 40 sealingly disposed between the tank and the soleplate the chamber covering substantially the entire soleplate by extending parallel and coextensive therewith and sealed as shown in FIG. 1 to separate the tank and soleplate and provide an air layer sealed from the outside therebetween. In this manner the soleplate is insulated from contact with the tank and the soleplate may be either metallic or plastic as desired.

Figure 3:
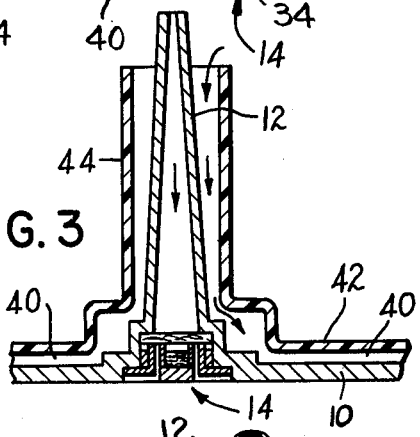
FIG. 3 is a partial sectional view of FIG. 1 showing the modification shown in broken lines in FIG. 2.
Figure 2:
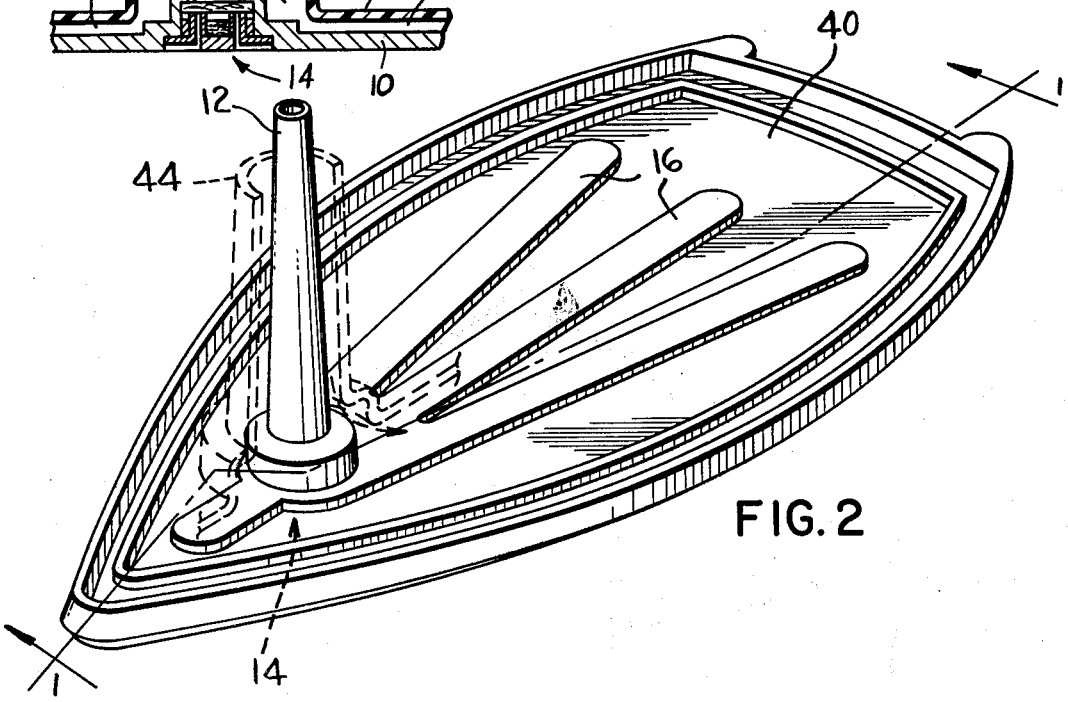
FIG. 2 is a partial perspective showing the soleplate and insulating chamber and illustrating a modification in broken lines.

As shown in FIG. 1 insulating thin chamber 40 may be formed by means of a separate plastic coverplate 42 closing and sealing with the bottom of plastic member 20. This completes the bottom of the tank and forms the top of the thin chamber 40. The coverplate is disposed so it is effectively sealed to the soleplate and casing as shown in FIG. 1. Thus formed, chamber 40 then becomes a dead air space since it is completely sealed all around. A preferred modification may direct steam into the thin chamber 40 as shown in FIGS. 2 and 3 where a second insulated steam conduit 44 may direct some of the steam into chamber 40 as shown by the dotted arrow to form a thin blanket of trapped steam between the tank and soleplate. Either modification may be used and provides the sole and even heat supplied to the soleplate depending on the presence or absence of the second conduit 44 or its equivalent.

The use of the air or steam in thin chamber 40 between the soleplate and the tank bottom over substantially their entire facing surfaces is advantageous because it provides for less condensation on the soleplate thereby permitting the soleplate face to get hotter than permitted if water is on the opposite side to cool it. This provides for better ironing because more heat is available to remove moisture in the fabric being ironed. In other words, condensation is less on the soleplate surface whether plastic or metallic. It is desired that the steam condense on the fabric and not on the soleplate. If the soleplate is hot it forms less condensation on it. The higher the soleplate temperature the less condensation, permitting the soleplate then to smooth the relaxed fibers in the fabric being ironed and the higher heat of the soleplate dries the fabrics faster. Further, with a thin chamber containing steam rather than water on the opposite side of the soleplate, the soleplate heats much faster and hotter because the steam, being hotter than the tank water, immediately enters the separating chamber thus resulting in a faster heating iron as well as a hotter soleplate as explained above. With the lack of condensation, with either dead air or steam, there is less drag on ironing resulting in smoother ironing and faster drying of the fabric. Thus, the interposition of the dead air or steam layer thin chamber provides numerous advantages over the prior art while providing a relatively simple few-part lightweight plastic iron of the electrolytic type.

While we have hereinbefore shown various modifications of the invention, obvious equivalent variations are possible in light of the above teachings. It is therefore to be understood that, within the scope of the appended claims, the invention may be practiced otherwise than as specifically described, and the claims are intended to cover such equivalent variations.

We claim:

1. A lightweight electrolytic steam iron having a soleplate with steam distributing means therefrom, a casing of electrically non-conducting material forming the walls of an internal water tank coextensive with and over the soleplate, spaced electrodes supported within said tank for immersion in the water contained therein generating steam from the water, an insulated steam conduit extending from the soleplate upwardly into said tank for directing saturated steam from said tank through said steam distributing means, the improvement comprising, a thin chamber sealingly disposed between said tank and soleplate parallel and coextensive therewith, said chamber separating said tank and soleplate over substantially their entire facing surfaces, means for introducing tank generated steam to said thin chamber, whereby the soleplate is insulated from contact with said tank and said chamber provides for sole and even heat distribution to the soleplate.

2. Apparatus as described in claim 1 wherein said casing has an open bottom and a plastic coverplate seals said open bottom to complete the bottom of said tank and form the top of said thin chamber.

3. Apparatus as described in claim 2 wherein said electrodes are supported in the rear of said iron for immersion in the tank water for steam generation in both flat and vertical positions of said iron.

4. Apparatus as described in claim 3 wherein a filter is disposed in said steam conduit before said steam distributing means.

5. Apparatus as described in claim 3 wherein said introducing means is a second insulated steam conduit connected to direct steam from said tank to said thin chamber to form a blanket of trapped steam between the tank and soleplate.

* * * * *